US007495531B2

(12) United States Patent
Kayano

(10) Patent No.: US 7,495,531 B2
(45) Date of Patent: Feb. 24, 2009

(54) FILTER AND RADIO COMMUNICATION APPARATUS USING THE SAME

(75) Inventor: Hiroyuki Kayano, Fujisawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 206 days.

(21) Appl. No.: 11/531,597

(22) Filed: Sep. 13, 2006

(65) Prior Publication Data

US 2007/0171004 A1 Jul. 26, 2007

(30) Foreign Application Priority Data

Jan. 23, 2006 (JP) ..... 2006-013767

(51) Int. Cl.
*H01P 1/20* (2006.01)

(52) U.S. Cl. ..... 333/204; 333/132

(58) Field of Classification Search ..... 333/132, 333/204; 505/210

See application file for complete search history.

(56) References Cited

U.S. PATENT DOCUMENTS 5,055,809 A 10/1991 Sagawa et al.
5,786,303 A * 7/1998 Mansour ..... 505/210
6,026,311 A 2/2000 Willemsen Cortes et al.
6,122,533 A * 9/2000 Zhang et al. ..... 505/210
RE37,636 E * 4/2002 Wortman et al. ..... 237/2 R
6,603,373 B2 * 8/2003 Tsujiguchi ..... 333/204
6,633,208 B2 10/2003 Salkola et al.
6,653,912 B2 * 11/2003 Robinson et al. ..... 333/132
6,720,849 B2 * 4/2004 Sasaki et al. ..... 333/204
6,980,841 B2 * 12/2005 Kai et al. ..... 505/210

* cited by examiner

*Primary Examiner*—Jean B Jeanglaude
(74) *Attorney, Agent, or Firm*—Oblon, Spivak, McClelland, Maier & Neustadt, P.C.

(57) ABSTRACT

A filter contains first and second resonators adjacent to each other in a first direction, each of the first resonator and the second resonator comprising a pair of first microstrip lines formed on a first region in a second direction perpendicular to the first direction and each having an open end and other end and a first width, and a second microstrip line arranged on a second region in the second direction, and connected between other ends of the pair of first microstrip lines, and having a second width smaller than the first width, wherein a minimum distance between the first microstrip lines adjacent to the first resonator and the second resonator is set at a value smaller than a minimum distance between the second microstrip lines adjacent to the first resonator and the second resonator.

17 Claims, 7 Drawing Sheets

FILTER AND RADIO COMMUNICATION APPARATUS USING THE SAME

CROSS-REFERENCE TO RELATED APPLICATIONS

This application is based upon and claims the benefit of priority from prior Japanese Patent Application No. 2006-013767, filed Jan. 23, 2006, the entire contents of which are incorporated herein by reference.

BACKGROUND OF THE INVENTION

1. Field of the Invention

The present invention relates to a filter and a radio communication apparatus using the same.

2. Description of the Related Art

Generally, a bandpass filter in a radio communication apparatus comprises a plurality of resonators arranged in cascade. Each resonator includes an inductor and a capacitor, and further contains a resistor when an effect of a loss is considered. In the filter of this type, it is possible to determine a passband frequency range and an attenuation amount of stopband by determining an inter-resonator coupling coefficient representing a coupling quantity between adjacent resonators and a value of an external Q factor representing a quantity to excite the resonators in the input and output ports thereof properly.

A filter using a microstrip line type resonator is known as such a filter. It is desired to miniaturize the filter in the radio communication apparatus. In the filter using the microstrip line type resonator, various approaches for miniaturization of the filter are proposed.

For example, U.S. Pat. No. 6,633,208B2, FIG. 11, discloses a filter approximating a plurality of half-wavelength resonators each having a configuration such that a narrow meander line is connected between ends of a pair of broad lines. The narrow meander line is arranged between the broad lines.

U.S. Pat. No. 5,055,809 (FIGS. 7 to 15) discloses a filter approximating a plurality of half-wavelength resonators each having a configuration such that a narrow line is connected between the ends of a pair of broad lines. The narrow lines are arranged on a side opposite to the open ends of the broad lines. Further, the width of the region on which a pair of broad lines are formed equals that of the region on which the narrow lines are formed.

It is preferable that the coupling between the adjacent resonators is capacitive coupling for the filter to be miniaturized. However, according to the filter of U.S. Pat. No. 6,633,208B2, a pair of broad lines and a pair of narrow lines approximate to each other with respect to an arrangement direction of the resonators, so that the full length of the filter in the arrangement direction of the resonators increases resulting in limiting miniaturization of the filter.

In the case of the filter of U.S. Pat. No. 5,055,809, when the adjacent resonators are closed to each other for miniaturization, the capacitive coupling occurring between the adjacent resonators due to a pair of broad lines has substantially the same value as the inductive coupling occurring due to the narrow lines. As a result, the capacitive coupling and the inductive coupling are cancelled to each other so that the deviation of coupling coefficient due to the dimensional accuracy increases. The deviation of coupling coefficient deteriorates the filter characteristic, resulting in increasing fluctuation of filter characteristic at the time of production of the filter.

BRIEF SUMMARY OF THE INVENTION

An aspect of the present invention provides a filter containing plural resonators adjacent to each other, comprising: a first resonator and a second resonator adjacent to each other in a first direction, which are fabricated on a substrate having a first region and a second region adjacent to each other in a second direction perpendicular to the first direction, each of the first resonator and the second resonator comprising: a pair of first microstrip lines formed on the first region in the second direction and juxtaposed in the first direction, each of the first microstrip lines having an open end and other end, and a first width; and a second microstrip line formed on the second region in the second direction and connected between other ends of the pair of first microstrip lines, the second microstrip line having a second width smaller than the first width, wherein a minimum distance between one of the first microstrip lines of the first resonator and adjacent one of the first microstrip lines of the second resonator is set at a value smaller than a minimum distance between one of the second microstrip lines of the first resonator and adjacent one of the second microstrip lines of the second resonator.

DETAILED DESCRIPTION OF THE INVENTION

Figure 1A:
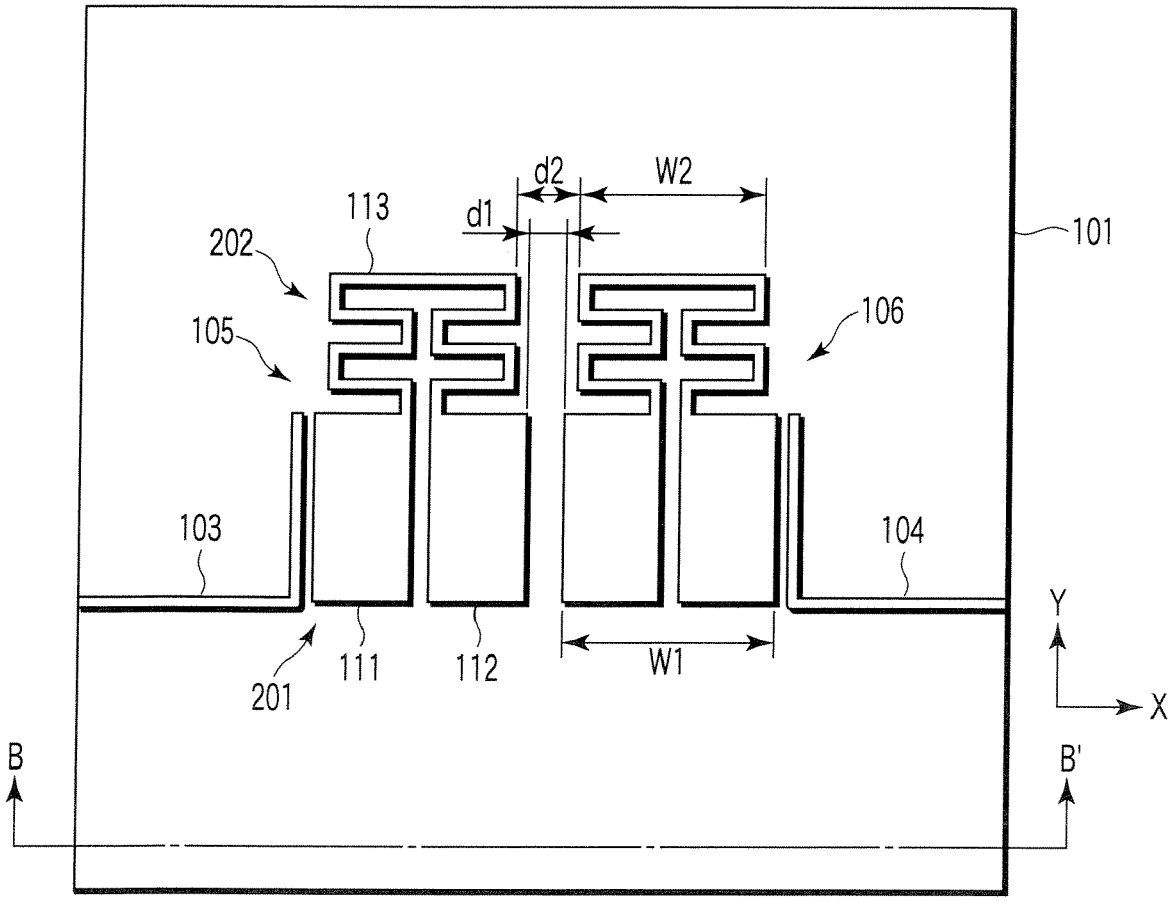
FIG. 1A shows a plane view of a filter according to a first embodiment.

There will now be described the embodiment of the present invention referring to the drawing.

Figure 1B:
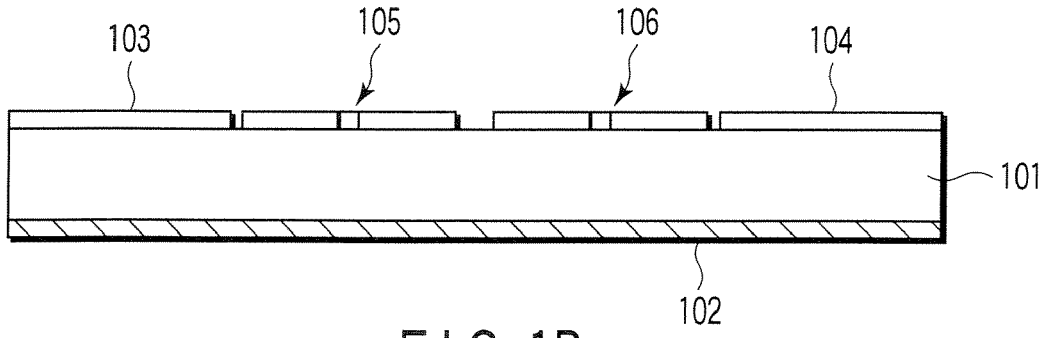
FIG. 1B shows a sectional view of the filter along an A-A' line of FIG. 1A.

As shown in FIGS. 1A and 1B, a ground plane 102 is formed on the rear surface of a dielectric substrate 101. An input line 103 to receive an input signal, an output line 104 to output an output signal and two adjacent half-wavelength resonators 105 and 106 are formed on the front surface of the dielectric substrate 101. One end of each of the input line 103 and output line 104 is extended to an end of the substrate 101 and connected to a circuit outside the filter on the end of the substrate 101.

For example, magnesium oxide or sapphire of around 0.1 mm to 1 mm in thickness is used for materials of the dielectric substrate 101. The ground plane 101, input line 103, output line 104, and resonators 105 and 106 are made of conductor materials, for example, a metal such as copper, silver, gold; a superconductor such as niobium or niobium tin; or an oxide superconductor such as $YB_{a2}Cu_3O_{7-x}$.

The ground plane 102 is formed on the rear surface of the dielectric substrate 101 and the conductor pattern is formed on the front surface of the substrate 101 as described above. Such a structure is called a microstrip line structure. The conductor pattern itself formed on the front surface of the substrate 101 is referred to as a microstrip line hereinafter.

Figure 2:
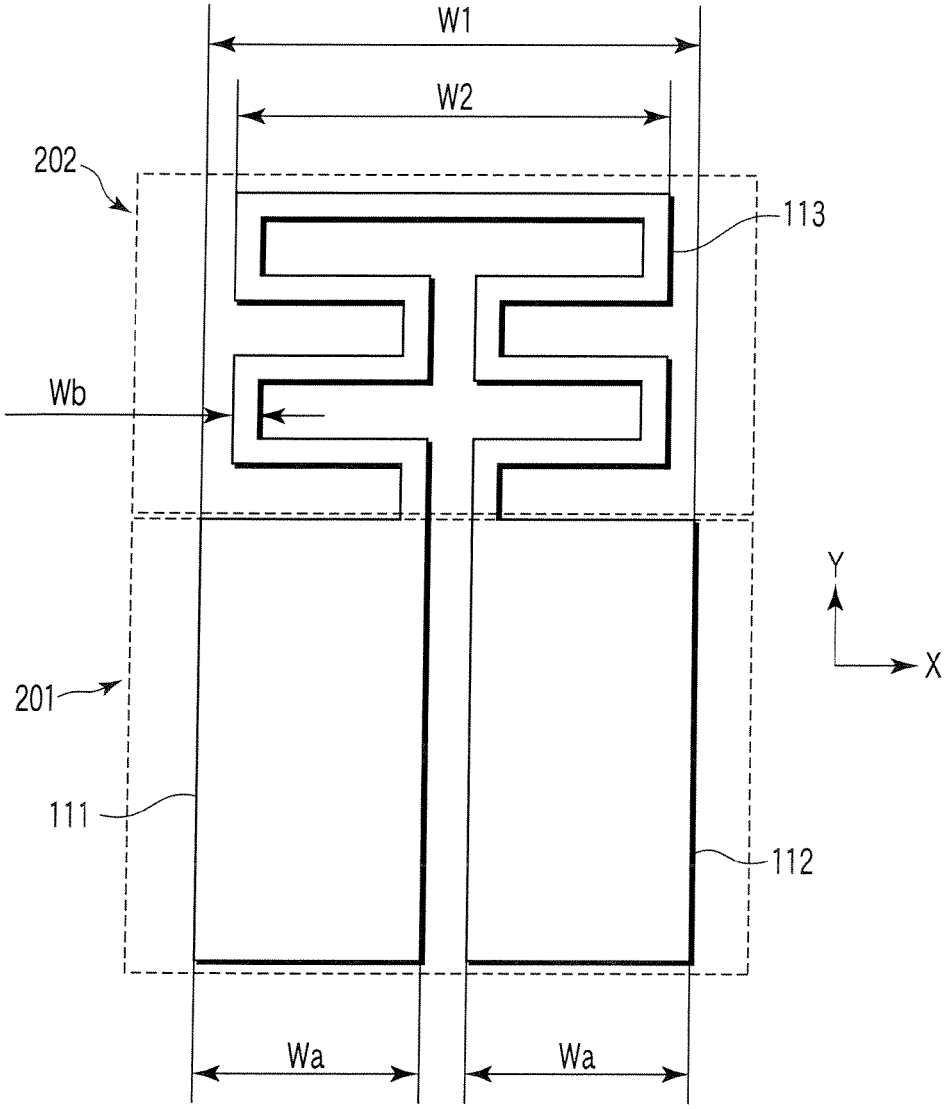
FIG. 2 shows an enlarged plane view of the resonator of the filter shown in FIGS. 1A and 1B.

The resonators 105 and 106 are arranged in proximity to each other in a lateral direction (a direction of an arrow X) in FIG. 1A, and have the same shape. The resonator 105 is explained referring to FIG. 2 showing an enlarged part of a part of FIG. 1A. The resonator 105 comprises a pair of first lines 111 and 112 formed on a first region 201 in a vertical direction (a Y-direction of the arrow perpendicular to the X-direction) of FIG. 1A and a second line 113 formed on a second region 202 in a meander shape. The first region 201 and the second region 202 are adjacent to each other in the Y-direction. The lines 111 and 112 have open ends on a side opposite to the line 113, which is connected between the other ends of the lines 111 and 112. The input line 103 is coupled with the line 111 of the resonator 105, and the output line 104 is coupled with the line 112 of the resonator 106.

Wa>Wb indicates a relation between the width Wa of each of the lines 111 and 112 and the width Wb of the line 113. d1<d2 indicates a relation between the minimum length d1 between the first regions 201 of the resonators 105 and 106 (i.e., minimum length between the line 112 of the resonator 105 and the line 111 of the resonator 106 adjacent thereto) and the minimum length d2 between the second regions (minimum length between the lines 113 of the resonators 105 and 106). In FIGS. 1A and 1B, the relation between the length W1 of the first region 201 in the X-direction (a sum of the total 2Wa of the width of each of the lines 111 and 112 and the distance between the lines 111 and 112) and the length W2 of the second region 202 is W1>W2. Further, the total electric length of the lines 111, 112 and 113 is approximately half-wave length (λ/2). In other words, the resonators 105 and 106 each are a half-wavelength resonator.

Figure 3:
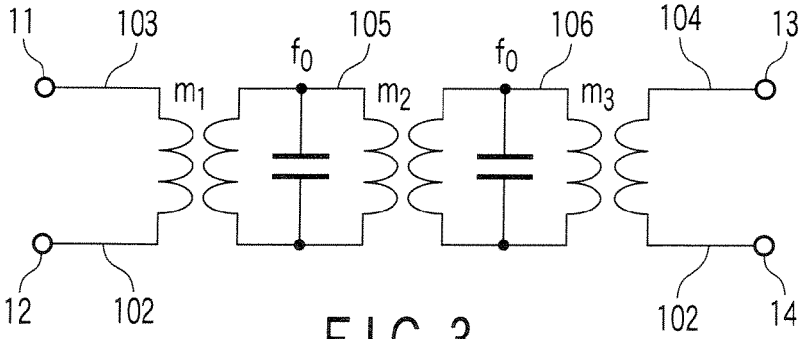
FIG. 3 is an equivalent circuit diagram of the filter shown in FIGS. 1A and 1B.

There will be explained an operation of the filter shown in FIGS. 1A and 1B and an advantage thereof. In FIG. 3 illustrating an equivalent circuit of the filter shown in FIGS. 1A and 1B, an input terminal 11 is connected to the input line 103, and a ground terminal 12 is connected to ground plane 102. The input signal supplied between the input terminal 11 and ground terminal 12 passes through the resonators 105 and 106 in turn and then extracted from between the output terminal 13 and ground terminal 14. The output terminal 13 is connected to the output line 104, and the ground terminal 14 is connected to the ground plane 102.

The resonators 105 and 106 are expressed with an inductor and a capacitor in equivalent as shown in FIG. 3. When an effect of a loss is considered, a resistance is added. The resonance frequencies of the resonators 105 and 106 when there is no resistance are expressed in the following equation.

$$f_0=1/\mathrm{sqrt}(L\times C) \quad (1)$$

where $f_0$ indicates a resonance frequency, sqrt a square root, L an inductance, C a capacitance, respectively.

It is possible to determine a passband frequency range of a filter and a magnitude of attenuation of stopband by determining properly an external Q factor m1 when viewed the initial stage (first stage) resonator 105 from the input terminal 11, an external Q factor m1 when viewed the initial stage (fourth stage) resonator 106 from the input terminal 13, and an inter-resonator coupling coefficient m2 representing a coupling quantity between the resonators 105 and 106.

Figure 4:
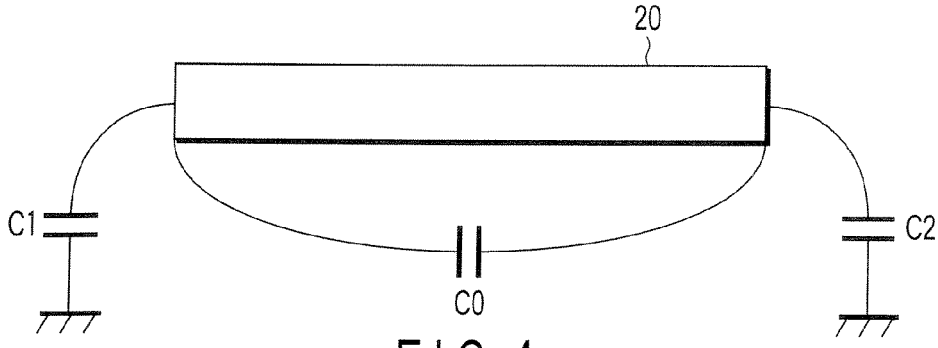
FIG. 4 is a diagram showing an equivalent circuit of a miniaturized microstrip line type half-wavelength resonator.
Figure 5:
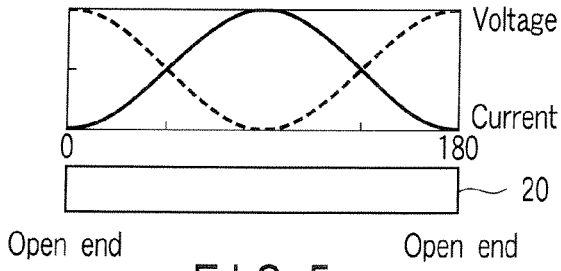
FIG. 5 is a diagram showing current distribution and voltage distribution in the microstrip line type half-wavelength resonator.

In an equivalent circuit of a half-wavelength resonator 20 shown in FIG. 4, the physical entire length of the resonator 20 can be shortened by coupling between two open ends of the half-wavelength resonator 20 by a capacitor C0. Further, when a broad line of low impedance is used for each of the open ends of the half-wavelength resonator 20, the capacities C1 and C2 between the open ends and the ground increase. This is effective for shortening the physical entire length of the resonator 20.

Figure 6:
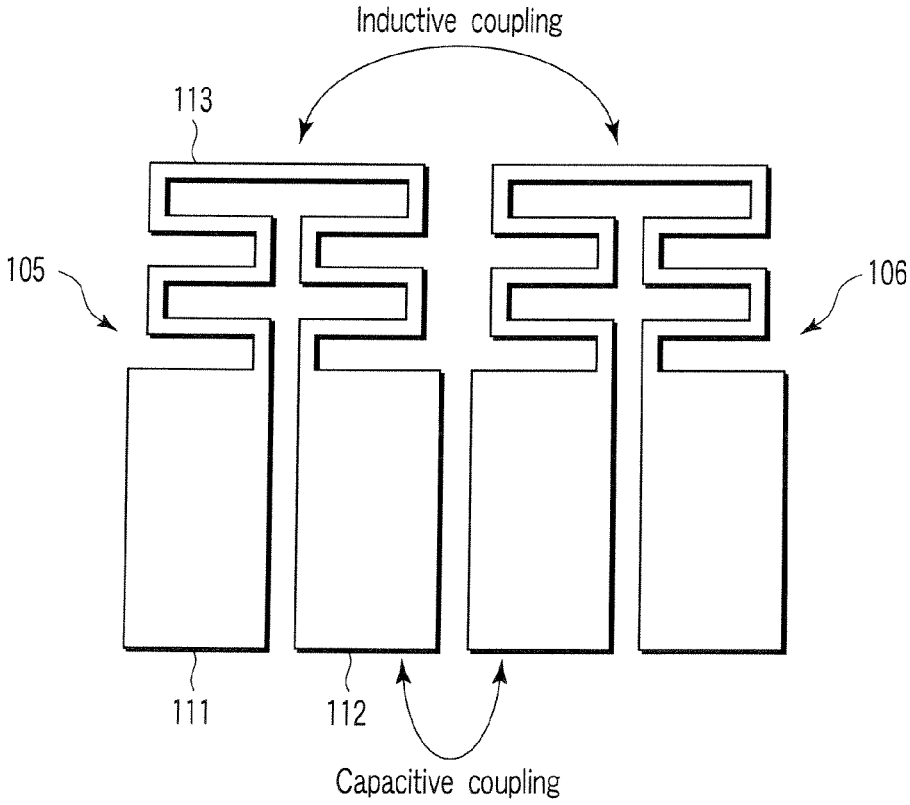
FIG. 6 is a diagram for explaining capacitive coupling and inductive coupling between adjacent resonators in the filter shown in FIGS. 1A and 1B.

As shown in FIG. 6, the voltage becomes maximum at each of two open ends of the half-wavelength resonator 20, and the current becomes maximum at the intermediate position of the resonator 20. Discussing the resonators 105 and 106 of the filter shown in FIGS. 1A and 1B from this standpoint, the following can be mentioned. The coupling state between the resonators 105 and 106 is shown in FIG. 6.

The shortest distance between the first regions of the resonators 105 and 106, that is, distance between the open end of the line 112 of the resonator 105 and the open end of the line 111 of the resonator 106 is d1. In other words, the maximum voltage points at the open ends of the half-wavelength resonators approach to each other with the distance d1. As a result, the capacitive coupling between the resonators 105 and 106 can be realized.

On the other hand, the shortest distance between the second regions of the resonators 105 and 106, that is, distance between the line 112 of the resonator 105 and the line 111 of the resonator 106 is d2. In other words, the maximum current points at the intermediate positions of the half-wavelength resonators approach to each other. As a result, the inductive coupling between the resonators 105 and 106 can be realized.

Figure 7:
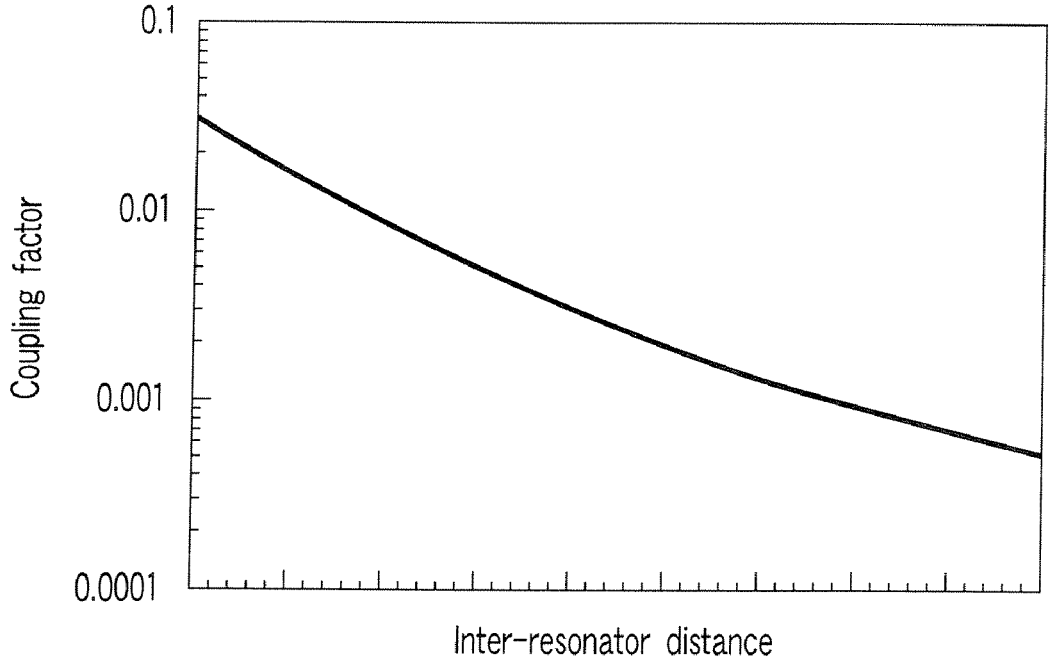
FIG. 7 is a diagram showing a computed result of coupling coefficient with respect to a distance between the adjacent resonators in the case that the adjacent resonators have only capacitive coupling.
Figure 8:
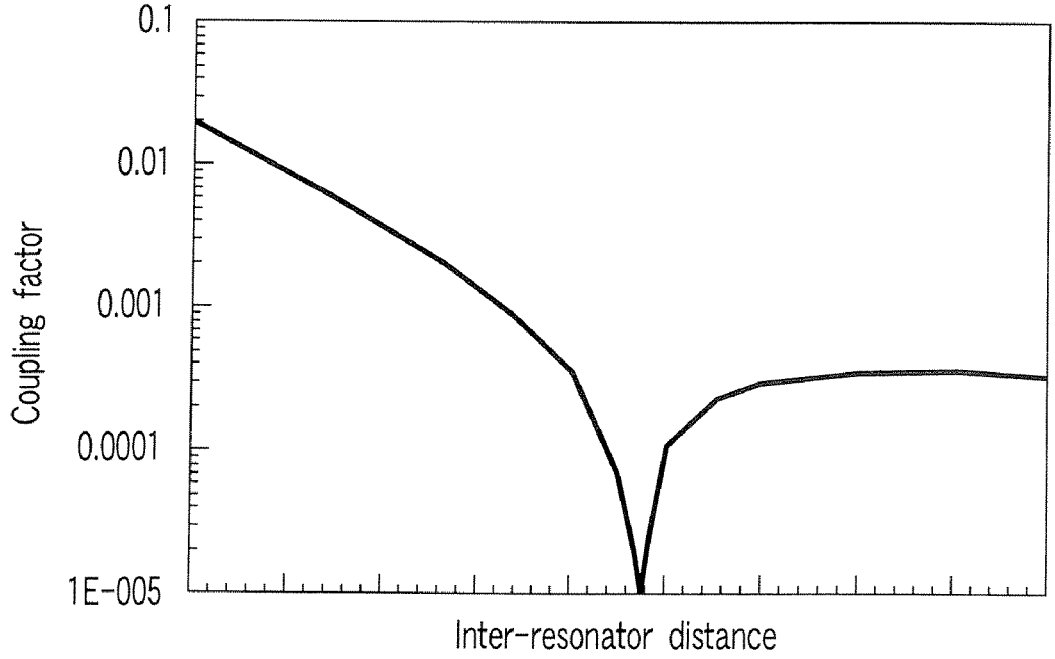
FIG. 8 is a diagram showing a computed result of coupling coefficient with respect to the distance between the adjacent resonators in the case that the adjacent resonators have capacitive coupling and inductivity coupling.

As explained above, generally when adjacent two resonators are miniaturized, capacitive and inductive couplings occur. When both of the capacitive and inductive couplings are cancelled to each other, a change of the coupling quantity (coupling coefficient) increases. FIGS. 7 and 8 show the computed results of coupling coefficients with respect to the distance between the adjacent resonators in the case that the adjacent resonators have only capacitive coupling and the case that the adjacent resonators have capacitive coupling and inductivity coupling.

As shown in FIG. 7, the capacitive coupling suddenly decreases with respect to the distance between the adjacent resonators. In contrast, a rate at which the inductive coupling decreases with respect to the distance between the adjacent resonators decreases. The total coupling coefficient becomes zero at the point that the coupling coefficients of the capacitive coupling and the inductive coupling become equal as shown in FIG. 8. When the coupling coefficient becomes zero, a degree of change of the coupling coefficient with respect to change of the distance between the adjacent resonators increases.

Because the inductive coupling is easy to be produced between the adjacent resonators and the other resonators other than the adjacent resonators, it is effective to use only capacitive coupling in a filter for a desired coupling coefficient to be formed between the adjacent resonances. In the filter shown in FIGS. 1A and 1B, the shortest distance d1 between the first regions 201 for forming the capacitive coupling between the adjacent resonators 105 and 106 is set at a value smaller than the shortest distance d2 between the second regions 202. Therefore, the zero point of the coupling coefficient between the resonators 105 and 106 can be shifted in a direction of increasing distance between the adjacent resonators. Shifting the zero point of the coupling coefficient makes it possible to suppress a degree of a change of the coupling coefficient with respect to the distance between the resonators 105 and 106. Accordingly, it is possible to decrease variation of the coupling coefficient between the adjacent resonators in producing the filter. As a result, it can be expected to shorten the adjustment time of the filter and improve yield.

Further, when the length W2 of the second region 202 in an X-direction is set at a range of not more than 90% of the length W1 of the first region, it is possible to realize coupling similar to the case of only capacitive coupling in a range of coupling coefficient to be necessary to configure a general filter.

Further, in the filter of FIGS. 1A and 1B, in each of the resonators 105 and 106, the narrow line 113 is disposed on the second region 202 adjacent to the first region 201 in a Y-direction, on which a pair of broad lines 111 and 112 are disposed. Accordingly, the filter is smaller in occupation length compared with a filter of patent document 1 in which a narrow line is arranged between a pair of wide lines, resulting in decreasing in size.

Figure 9:
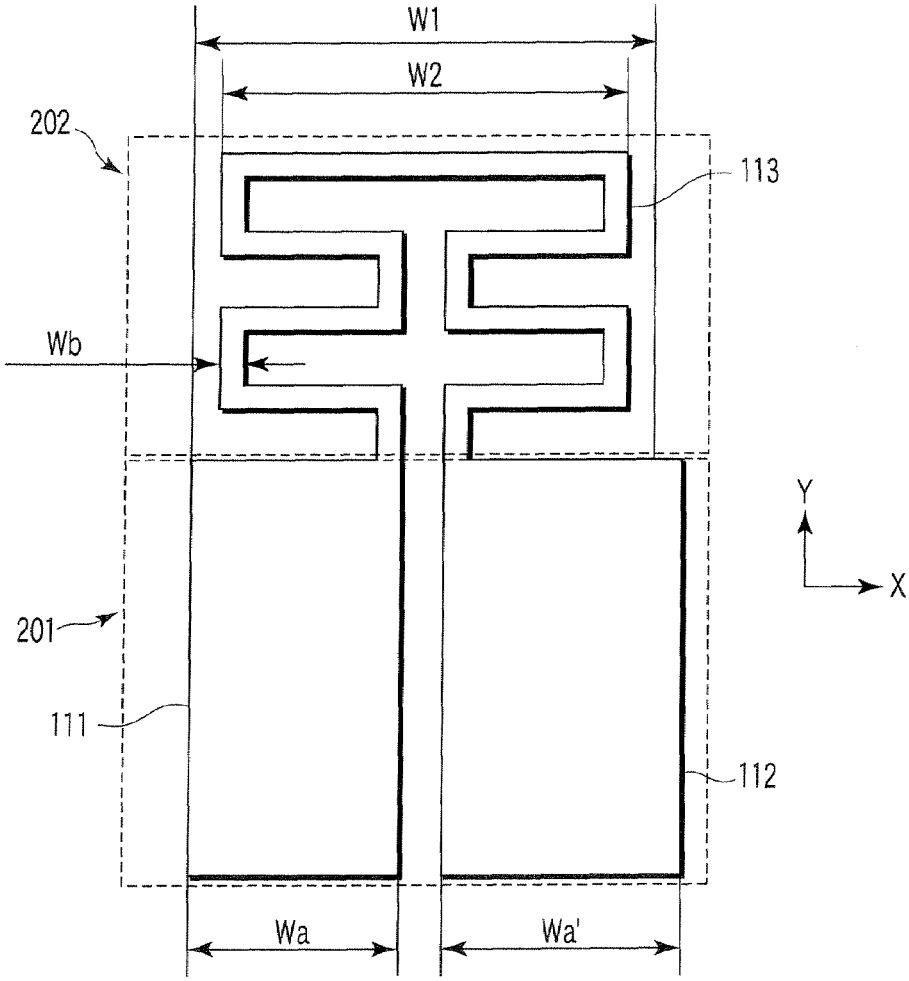
FIG. 9 is a plane view of a modification of the resonator of FIG. 3.

FIG. 9 is a modification of the resonator included in the filter of FIGS. 1A and 1B. In this modification, the width Wa of the line 111 differs from the width Wa' of the line 112 as understood in comparison with FIG. 3. In the modification of FIG. 9, Wa<Wa', where the relation between the widths Wa and Wa' and the width Wb of the line 113 are Wa>Wb and Wa'>Wb.

A filter of another embodiment will be described referring to FIGS. 10 to 15.

Figure 10:
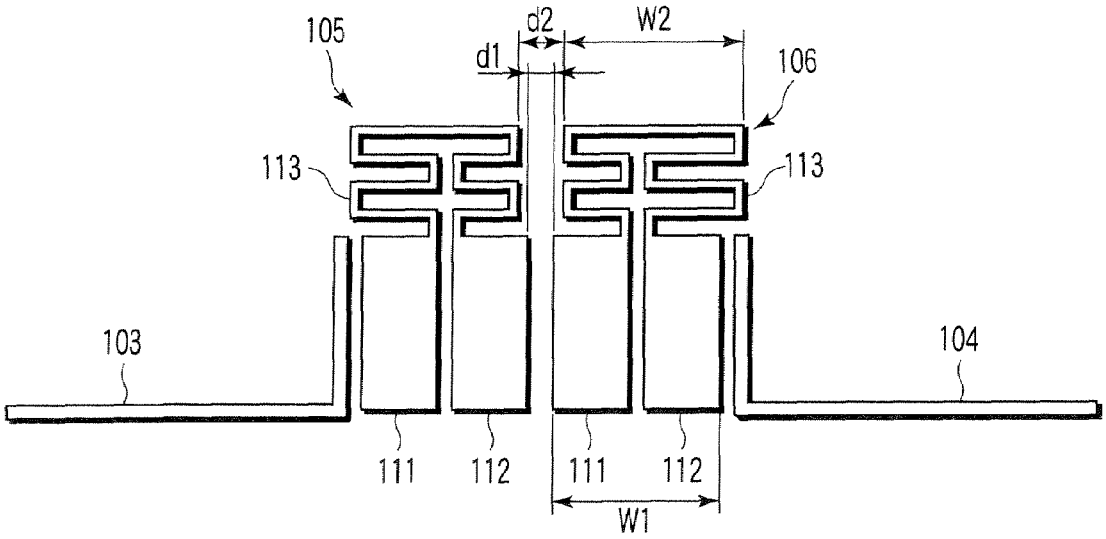
FIG. 10 is a plane view of a filter according to another embodiment.

The filter shown in FIG. 10 is substantially W1=W2, where W1 is the length of the first region 201 in an X-direction (the sum of the total width 2Wa of the lines 111 and 112 and the distance between the lines 112 and 112) and W2 is the length of the second region 202. The shape of the line 113 is unsymmetric in an X-direction and symmetric between the resonators 105 and 106.

The relation (Wa>Wb) of the width Wa of the lines 111 and 112 and the width Wb of the line 113, the relation (d1<d2) of the shortest distance d1 between the first regions of the resonators 105 and 106 and the shortest distance d2 between the second regions 202, and the total electric length of the lines 111, 112 and 113 which is approximately half-wave length are similar to the previous embodiment. Accordingly, the filter of FIG. 10 has an advantage similar to the filter shown in FIGS. 1A and 1B.

Figure 11:
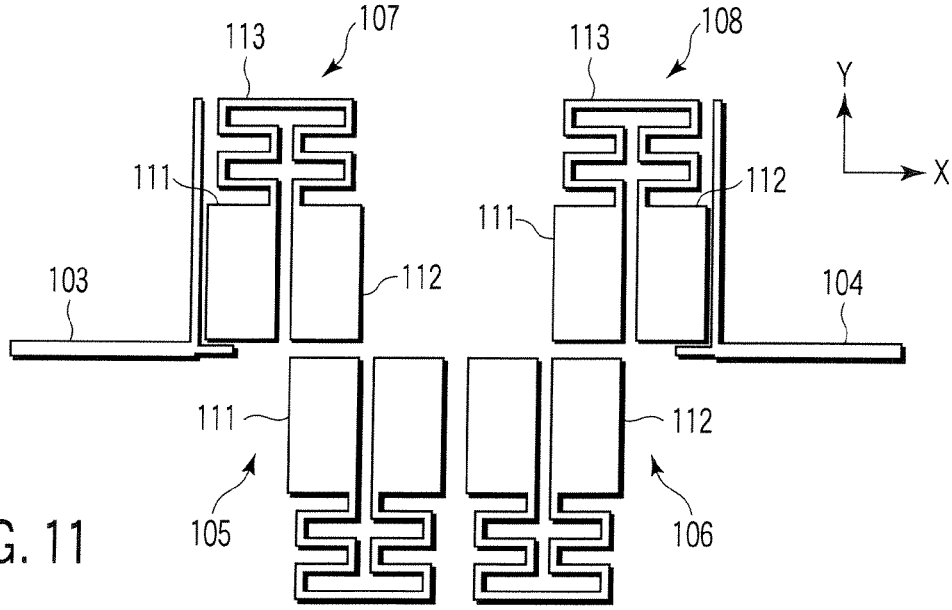
FIG. 11 is a plane view of a filter according to another embodiment.

FIG. 11 shows a filter having four resonators arranged in cascade between the input wire line 103 and output line 104. The second stage resonator 105 and the second stage resonator 106 are similar to FIGS. 1A and 1B. The first stage resonator 107 and the fourth stage resonator 108 are similar to the resonators 105 and 106. The input line 103 is coupled with the lines 111 and 113 of the resonator 107, and the output line 104 is coupled with the lines 112 and 113 of the resonator 108.

On the other hand, the coupling of the resonators 105 and 107 is realized only by coupling the line 112 of the resonator 107 with the line 111 of the resonator 105. Similarly, the coupling of the resonators 106 and 108 is realized only by coupling the line 111 of the resonator 108 with the line 112 of the resonator 106.

Figure 12:
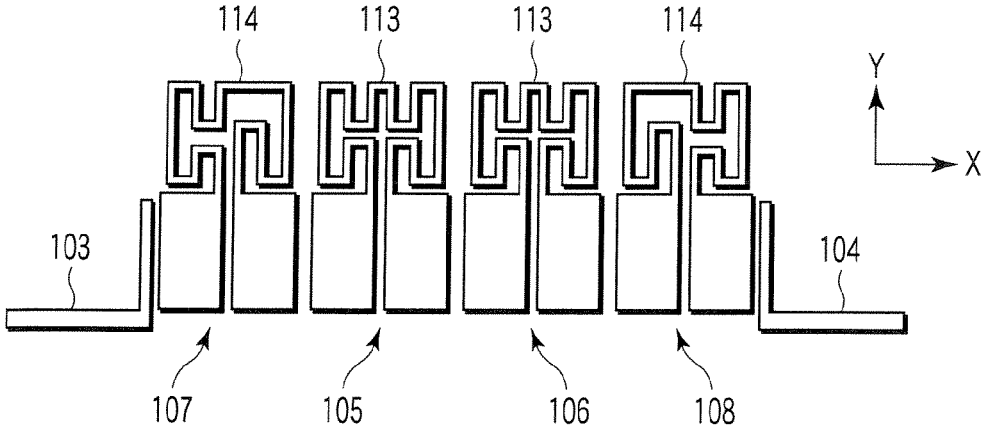
FIG. 12 is a plane view of a filter according to another embodiment.

FIG. 12 shows a filter having four resonators arranged in cascade between the input line 103 and output line 104 like FIG. 11. However, in the filter of FIG. 12, the second lines 114 of the first and fourth stage resonators 107 and 108 have a left-right asymmetrical shape unlike the second lines 113 of the second and third stage resonators 105 and 106, with the physical length being set at a value shorter than the line 113.

Figure 13:
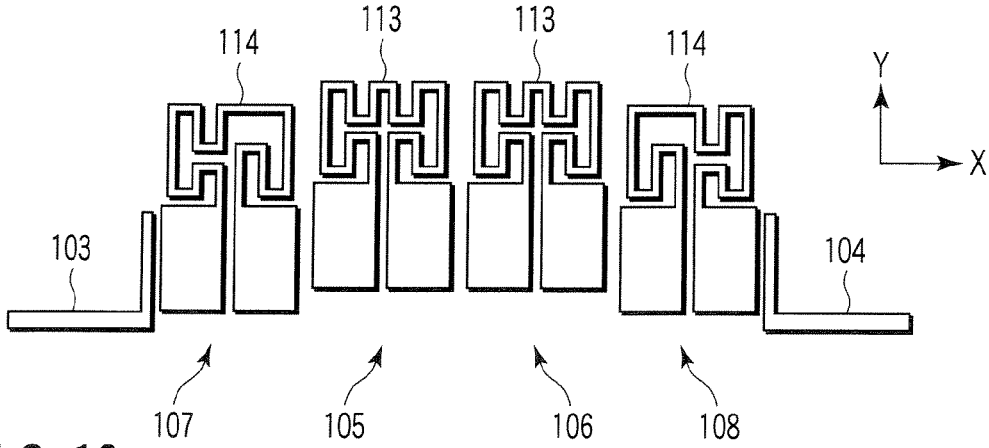
FIG. 13 is a plane view of a filter according to another embodiment.

Coupling of the input line 103 with the first stage resonator 107 and coupling of the output line 104 with the second resonator 108 are called an external Q coupling. A small external Q is required in realizing a filter of a broad band, and the resonators 107 and 108 must be strongly coupled with the input line 103 and the output line 104, respectively, to provide the external Q. If strong coupling is realized, the resonance frequency of the resonator largely falls. Therefore, in the filter of FIG. 12, the resonance frequency is increased by shortening the physical length of the second line 114 in the resonators 107 and 108 to provide the external Q. In this case, the parameter to be evaluated beforehand can be reduced by making the physical length of the lines 111 and 112 constant. Expanding the above intention, the length and width of the line configuring the resonator may be different every resonator. FIG. 13 shows a modification of the filter of FIG. 12, wherein the positions of the resonators 105 and 106 are slightly shifted from the positions of the resonators 107 and 108 in a direction perpendicular to an arrangement direction of the resonators.

Generally, when a filter is fabricated using three or more resonators as shown in FIGS. 12 and 13, it is necessary to change a shape of a resonator according to magnitude of coupling in order to make the magnitude of coupling differ between adjacent resonators. When two resonators are used, they may have the same shape.

Figure 14:
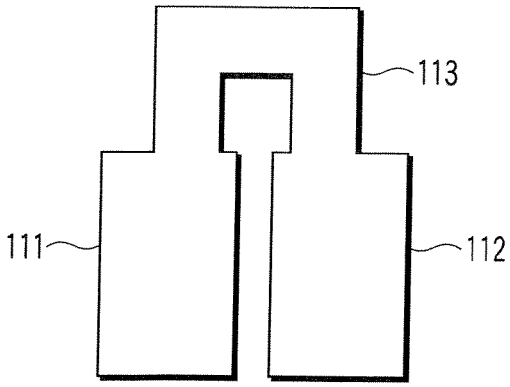
FIG. 14 is a plane view of another resonator included in a filter according to another embodiment.
Figure 15:
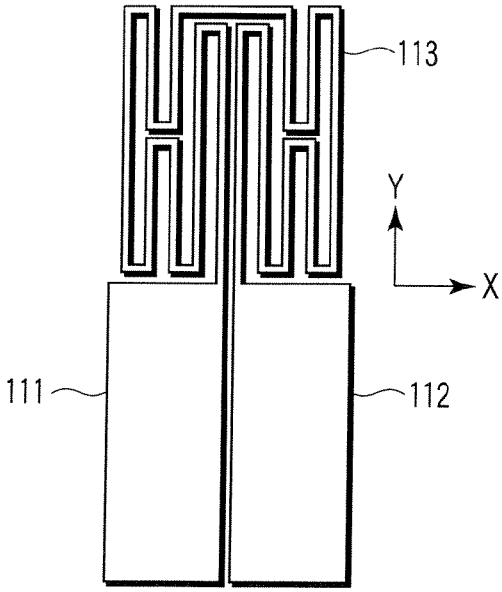
FIG. 15 is a plane view of another resonator included in a filter according to another embodiment.
Figure 16:
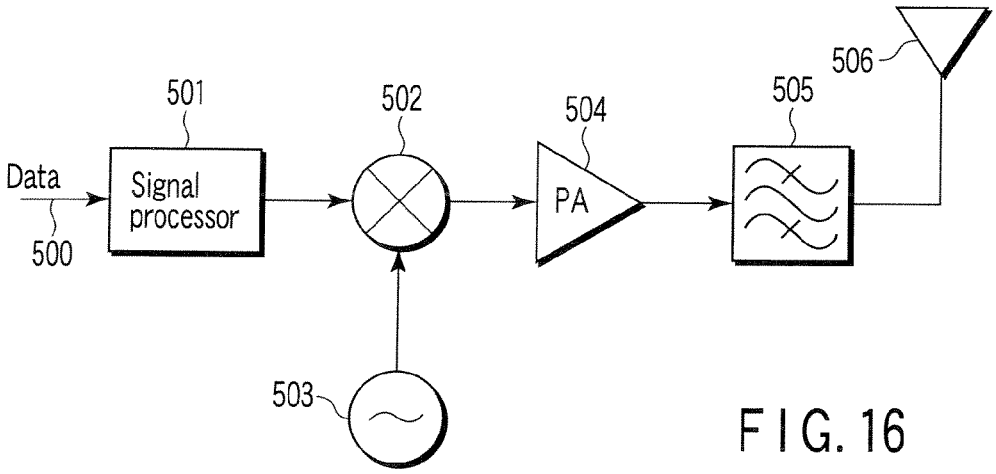
FIG. 16 is a block diagram of a transmitter of a radio communication apparatus using the filter according to the embodiment.

FIGS. 14 and 15 each show a further modification of the resonator. The resonator of FIG. 14 has a simple shape that the second line 113 is folded once. The resonator of FIG. 15 has a shape that the second line 113 is folded several times in a lengthwise direction. As thus described, the second line 113 can be modified in shape in a range in which the minimum distance between the first regions 201 of the resonators 105 and 106 is smaller than that between the second regions 202 as explained in FIGS. 1A and 1B or a range in which the length of the second region 202 where the line 113 is arranged is smaller than the length of the first region 201 where the lines 111 and 112 are arranged, in a X-direction An embodiment wherein the filter is applied to a radio communication apparatus is explained referring to FIGS. 16 and 17. According to a transmitter of a radio communication apparatus shown in FIG. 16, data 500 to be transmitted is input to a signal processor 501 and subjected to digital-to-analog conversion, encoding and modulation to generate a transmit signal of a baseband or an intermediate frequency (IF) band. A transmitting signal from the signal processor 501 is input to a frequency converter (mixer) 502, and multiplied by the local signal from the local signal generator 503. In other words, the transmitting signal is frequency-converted into a signal of a radio frequency (RF) band, or up-converted.

The RF signal output from the mixer 502 is amplified with a power amplifier 504 and input to a bandpass filter (transmission filter) 505 and band-limited thereby to remove an unnecessary frequency component. The resultant signal is supplied to an antenna 506. The bandpass filter 505 can use a filter explained in the above embodiment.

Figure 17:
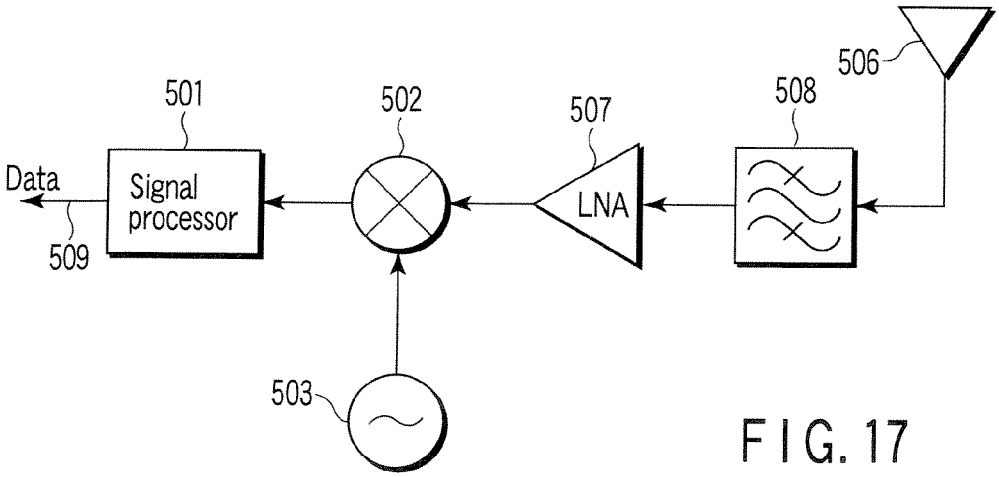
FIG. 17 is a block diagram of a receiver of a radio communication apparatus using the filter according to the embodiment.

A receiver of the radio communication apparatus is explained referring to FIG. 17 hereinafter.

A signal received with the antenna is input to a bandpass filter (receive filter) 508 and band-limited thereby to remove an unnecessary frequency component, and then input to a low noise signal amplifier 507. The received signal is amplified with the low noise signal amplifier 507. The amplified received signal is input to a mixer 502 and multiplied by a local signal to be converted to a baseband or an intermediate frequency. The signal of low frequency is input to the signal processor 501 and demodulated therein. The demodulated signal is output from the signal processor 501 as receive data 509. The bandpass filter 508 can use the filter explained in the above embodiment.

According to the present invention, the filter can be easy miniaturized, and the change of the coupling coefficient due to accuracy of dimension between adjacent resonators is decreased. Further, shortening of adjustment time of the filter and improvement of yield can be realized.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A filter containing plural resonators adjacent to each other, comprising:

a first resonator and a second resonator which are arranged in proximity to each other in a first direction and each of which is fabricated on a substrate having a first region and a second region which are adjacent to each other in a second direction perpendicular to the first direction, the first region having a first width and the second region having a second width smaller than the first width, each of the first resonator and the second resonator comprising:

a pair of first microstrip lines formed on the first region having the first width larger than the second width and juxtaposed in the first direction, each of the first microstrip lines having an open end and an other end, and a sum of widths of the first microstrip lines and a distance between the first microstrip lines being equal to the first width; and a second microstrip line formed on the second region having the second width smaller than the first width and connected between other ends of the pair of first microstrip lines, the second microstrip line having the second width smaller than the first width of the first region, wherein a minimum distance between one of the first microstrip lines of the first resonator adjacent to the second resonator in the first direction and one of the first microstrip lines of the second resonator that is adjacent to the one of the first microstrip lines is set at a value smaller than a minimum distance between the second microstrip line of the first resonator and the second microstrip line of the second resonator that is adjacent to the second microstrip line of the first resonator.

2. The filter according to claim 1, wherein the second microstrip line differs in length between the first resonator and the second resonator.

3. The filter according to claim 1, wherein a total electric length of the first microstrip lines and the second microstrip line is approximately a half-wave length.

4. The filter according to claim 1, further comprising an input line to which an input signal is input and an output line from which an output signal is extracted, and a plurality of resonators containing the first resonator and the second resonator being arranged in cascade between the input line and the output line.

5. The filter according to claim 1, which further comprises an input line to which an input signal is input and an output line from which an output signal is extracted, and wherein a plurality of first resonators containing the first resonator and a plurality of second resonators containing the second resonator are arranged in cascade between the input line and the output line with one of the first resonators being connected to the input line and one of the second resonators being connected to the output line, and the electric length of the second microstrip line of each of the one of the first resonators and the one of the second resonators is shorter than the electric length of the second microstrip line of each of other of the first resonators and other of the second resonators.

6. The filter according to claim 1, wherein the second microstrip line is formed in a meander shape.

7. A radio communication apparatus comprising:

a power amplifier to amplify a radio frequency signal;

the filter of claim 1 which band-limits an output signal from the power amplifier; and an antenna to transmit an output signal of the filter.

8. A radio communication apparatus comprising:

an antenna to receive a radio frequency signal;

the filter of claim 1 which band-limits an output signal from the antenna; and a low noise amplifier to amplify an output signal of the filter.

9. A filter containing plural resonators adjacent to each other, comprising:

a first resonator and a second resonator which are arranged in proximity to each other in a first direction and fabricated on a substrate having a first region and a second region which are adjacent to each other in a second direction perpendicular to the first direction, the first region having a first width and the second region having a second width smaller than the first width, each of the first resonator and the second resonator comprising:

a pair of first microstrip lines formed on the first region having the first width larger than the second width and juxtaposed in the first direction and each of first microstrip lines having an open end and an other end and a sum of widths of the first microstrip lines and a distance between the first microstrip lines being equal to the first width; and a second microstrip line formed on the second region having the second width smaller than the first width and connected between other ends of the pair of first microstrip lines, the second microstrip line having the second width smaller than the first width.

10. The filter according to claim 9, wherein the second width of the second region in the second direction is not more than 90% of the first width of the first region in the second direction.

11. The filter according to claim 9, wherein the second line differs in length between the first resonator and the second resonator.

12. The filter according to claim 9, wherein a total electric length of the first microstrip lines and the second microstrip line is approximately a half-wave length.

13. The filter according to claim 9, further comprising an input line to which an input signal is input and an output line from which an output signal is extracted, and a plurality of resonators containing the first resonator and the second resonator being arranged in cascade between the input line and the output line.

14. The filter according to claim 9, which further comprises an input line to which an input signal is input and an output line from which an output signal is extracted, and wherein a plurality of resonators containing a plurality of first resonators and a plurality of second resonators, which are arranged in cascade between the input line and the output line with one of the first resonators being connected to the input line and one of the second resonators being connected to the output line, and the length of the second microstrip line of each of the one of the first resonators and the one of the second resonators is shorter than the length of the second microstrip line of each of other of the first resonators and other of the second resonators.

15. The filter according to claim 9, wherein the second microstrip is formed in a meander shape.

16. A radio communication apparatus comprising:

a power amplifier to amplify a radio frequency signal;

the filter of claim 9 which band-limits an output signal from the power amplifier; and an antenna to transmit an output signal of the filter.

17. A radio communication apparatus comprising:

an antenna to receive a radio frequency signal;

the filter of claim 9 which band-limits an output signal from the antenna; and a low noise amplifier to amplify an output signal of the filter.

* * * * *